US005745964A

United States Patent [19]

Lüer et al.

[11] Patent Number: 5,745,964

[45] Date of Patent: May 5, 1998

[54] PUSH-BUTTON CLOSURE PART

[75] Inventors: Harald Lüer; Volker Scheffels; Thomas Pferdehirt, all of Wuppertal, Germany

[73] Assignee: YKK Corporation, Tokyo, Japan

[21] Appl. No.: 755,303

[22] Filed: Nov. 22, 1996

[30] Foreign Application Priority Data

Nov. 23, 1995 [DE] Germany ..... 195 43 728.4

[51] Int. Cl.[6] ..... A44B 17/00

[52] U.S. Cl. ..... 24/687; 24/113 MP; 24/689; 24/691

[58] Field of Search ..... 24/687, 688, 689, 24/691, 692, 94, 95, 93, 113 MP

[56] References Cited

U.S. PATENT DOCUMENTS

| | | | |
|---|---|---|---|
| 1,604,020 | 10/1926 | Carr | 24/689 |
| 1,910,951 | 5/1933 | Hayden | 24/691 |
| 2,189,995 | 2/1940 | Reiter . | |
| 3,333,306 | 8/1967 | Daddona, Jr. | 24/691 |
| 4,698,881 | 10/1987 | Watanabe | 24/691 |

FOREIGN PATENT DOCUMENTS

| | | |
|---|---|---|
| 99790 | 4/1925 | Austria . |
| 0 191 424 | 8/1986 | European Pat. Off. . |
| 44156 | 6/1925 | Germany . |

*Primary Examiner*—Victor N. Sakran
*Attorney, Agent, or Firm*—Hill & Simpson

[57] ABSTRACT

A push-button closure part including a contoured button, a metallic rivet part having a rivet shank projecting from the underside of the button and an approximately radially extending, round rivet flange. The closure part includes a push button eyelet for slipping onto the rivet shank through a central opening. The rivet shank is deformed in a shallow S-shape which causes flexible material clasped between the rivet flange and the eyelet to be pressed between the edge of the central opening of the eyelet and rivet flange and also between the surrounding outer edge of the eyelet and the rivet flange.

9 Claims, 1 Drawing Sheet

PUSH-BUTTON CLOSURE PART

BACKGROUND OF THE INVENTION

The invention relates to a push-button closure part composed of a button part connected by a rivet part to an eyelet part across a thickness of a flexible material. In particular, the invention is directed to a "calotte-shaped"(spherical contoured) metallic button, and a metallic rivet part having a rivet shank that projects from the underside of the button, the rivet shank being deformable for being fixed to a push button eyelet after being passed through a flexible material such as cloth.

In a known push-button closure part of this type, the rivet part also has an approximately radially extending, round rivet flange. A downwardly and inwardly deformed button edge of the button engages under an edge of the rivet flange. The rivet part also comprises supporting clips formed by punching windows in a region between the edge of the rivet flange and the rivet shank, the clips bent over onto themselves such that they lie against the central region of the calotte-shaped button and support the latter. The push-button eyelet is slipped onto the rivet shank through a central opening and that, by deforming the rivet shank, the eyelet is fixed with reference to the rivet part and, thus, the calotte-shaped button. The flexible material is pressed between the edge of the central opening of the eyelet and the rivet flange with respect to the calotte-shaped button.

In an embodiment of this species that has been known for a long time and used to a great extent, the round rivet flange is in the form of an annular disk that extends in an approximately horizontal plane extending from an end of the rivet shank at the button side. The outer edge of this annular disk is firmly seized by rolling the button edge downward and inward by a total of about 270°. The unit composed of the rivet flange and the metallic button is flat corresponding generally to the flat profile of the rivet flange.

This embodiment has largely replaced an embodiment of a different species that has already been known for more than two decades and that was correspondingly extensively used, whereby a reinforcing plate lies against the underside of the calotte-shaped button instead of the supporting clips formed by punching windows from the material of the annular disk-shaped rivet flange and lying against the underside of the button. In this older embodiment, the retaining flange, as viewed in longitudinal section through the axis of the rivet shank, is fashioned approximately corrugated such that a first section that directly adjoins the rivet shank, and that is in contact with the reinforcing plate, is followed by a downwardly extended, second section proceeding at a distance from the button and from the reinforcing plate and that ultimately merges into a steeply upwardly drawn third section at the outer edge of the rivet flange. The rivet flange lies against the reinforcing plate located in the calotte-shaped button. Since the entire area of this upwardly drawn, third section is seized by the downwardly and inwardly deformed button edge, an especially long edge section of the button that leads downward from the upper button plane is required in this embodiment, instead of the rolling of the button edge by a total of about 270°. In this embodiment, the section proceeding at a greater distance from the button and the reinforcing plate serves, together with an outer flared flange of the eyelet defined at the rivet stem by deformation of the latter, for pressing the intervening, flexible material.

Compared to this older embodiment, the known embodiment of the species has the advantage that it does not require the use of an additional reinforcing plate at the underside of the calotte-shaped button. It has frequently turned out, however, that the inward displacement of the location of the pressing of the flexible material from the region of the outer flare edge of the eyelet toward the edge of the central opening of the push-button which is to be connected with this more simple structure, provides a less effective and less durable fixing of the flexible material.

FIG. 2A shows a traditionally fashioned structural unit formed of the button 1 and the rivet part 2 before being joined to the push-button eyelet 3. In this embodiment showing the prior art, the rivet part 2, is composed of a deformable rivet shank 4 and a flat, annular disk-shaped rivet flange 5 extending radially away therefrom and having a flange edge 6. The rivet part 2 is firmly seized by the calotte-shaped button 1 by rolling the button edge 7 down and in by about 270° and forms a unit therewith that has a very flat configuration. The rivet shank 4 projects away from the underside of the button 1 and, after being passed through a flexible material 8 that, for example, can be composed of a textile fabric or of a plastic foil or film. The shank 4 also passes through the cylindrical central opening 10 of the push-button eyelet 3 terminating in an edge 9, and can be deformed in the way shown in FIG. 2B. The rivet shank 4 is thereby rolled over forming a roll 11 at the outside, whereby the shank end 12 is seated under the edge 9 of the opening 10 for support thereof.

In order to intercept the forces arising proceeding from the outside of the button 1 during deformation of the rivet shank 4 without the button experiencing an aesthetically detrimental deformation, the rivet flange 5 is provided with supporting clips 14 formed by punching windows 13 between the rivet flange edge 6 and the rivet shank 4, the supporting clips 14 being bent over onto themselves such that they are seated against the underside of the calotte-shaped button 1 and can thus serve for transmitting forces acting from the outside.

It can be seen from FIG. 2B that the push-button eyelet 3 comprises an outer flare edge 15 in addition to the radially inwardly terminating edge 9 of the opening in a traditional way, the schematically indicated, standard push-button 4 spring 16 being support at the inside of this edge 15. The flexible material is loosely guided between the flared edge 15 and the roll-in of the button edge 7.

SUMMARY OF THE INVENTION

The invention is based on the object of improving the known push-button closure part such that, upon retention of the simpler structure, a more effective clamping and joining of the flexible material to the push-button closure part can be achieved.

In a push-button closure part, this object is essentially achieved in that a region of the rivet flange, the region wherein the supporting clips formed by punching and bending are located, is formed by a window section that, extends approximately parallel to the axis. The window section leads away from the button cover such as a calotte-shaped button, and merges into a supporting section that proceeds transversely relative to the axis and at a distance from the calotte-shaped button. A transition section extends approximately parallel to the axis and, together with the window section, defines the distance of the supporting section from the calotte-shaped button. The transition section adjoins the supporting section, the transition section merging into an outer edge of the rivet flange, the outer edge positioned directly against the calotte-shaped button in that region of said calotte-shaped button from which the button edge is conducted downward and inward approximately parallel to the axis for fixing the rivet part. The position of an edge of a central opening of a n eyelet is arranged with respect to the position of the outer edge of the eyelet such that the flexible material can be pressed not only between the edge of the central opening of the eyelet and the rivet flange but can also be additionally pressed between the outer edge of the eyelet and the supporting section of the rivet flange.

Although the inventive push-button closure part is formed of only three component parts, namely the button cover, the rivet part and the push-button eyelet, a pressing of the flexible material at two regions radially distanced from one another and, thus, an especially reliable fixing and, consequently, loadability of the push-button closure part is nonetheless assured.

It would be conceivable to provide a ring-like impression at approximately half the height of the transition section of the rivet flange and to have the edge region of the calotte-shaped button end in this impression. However, it has proven more beneficial in fabrication-related terms when the button edge extends down to the supporting section of the rivet part. The ring-like impression is omitted in this embodiment; the edge region of the calotte-shaped button, however, must be adapted to the spacing of the supporting section from the calotte-shaped button, i.e., must have a comparatively great height.

In order to assure that the outer edge of the eyelet exerts an adequately great pressing power on the supporting section of the rivet flange and the intervening flexible material is thus correspondingly pressed, it is of considerable advantage when an especially effective and reliable connection is assured between rivet shank and edge of the central opening of the eyelet. To this end, the rivet shank inventively is widened only over roughly its lower half facing away from the rivet flange until it is seated against the outside wall defining an edge of the central opening of the eyelet, and has its upper half deformed in the direction toward the rivet flange while being seated against and entraining that edge of the central opening of the eyelet projecting inward, i.e. projecting transversely relative to the axis, as well as pressing the flexible material. In this way, not only is the inside of the central opening region of the eyelet firmly seized by the rivet shank but the flexible material is also effectively pressed in the region of the outer edge of the eyelet.

Further details, advantages and features derive from the following description with reference to the attached drawing. Shown are:

DETAILED DESCRIPTION OF THE PREFERRED EMBODIMENTS

Figure 1A:
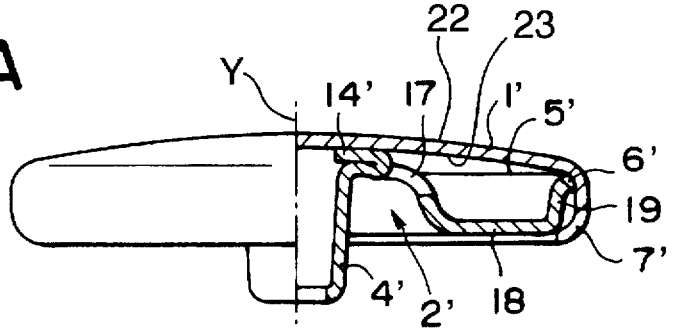
FIG. 1A is an axial section through a push-button closure part of the invention.

As can be seen from FIG. 1A, each push-button closure part in its completely assembled and pressed condition, is composed of a button cover such as a calotte-shaped metallic button 1', a metallic rivet part 2' and a push-button eyelet 3'.

The button 1' includes a top plate 22 and a surrounding button edge 7'.

Figure 2A:
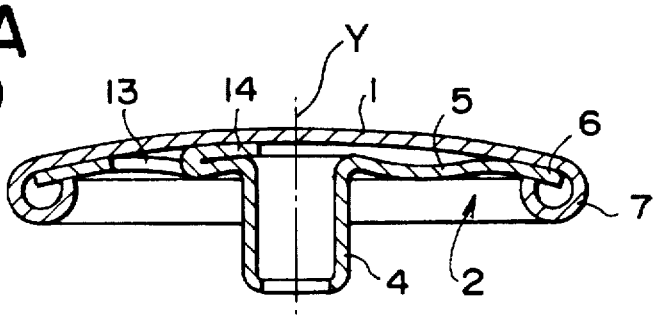
FIG. 2A (PRIOR ART)
FIG. 2A is an axial section through a push-button closure part of the prior art.
Figure 2B:
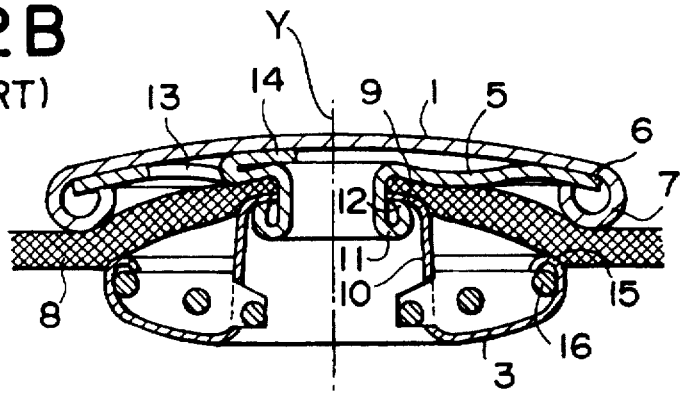
FIG. 2B (PRIOR ART)
FIG. 2B is an axial section of the closure part of FIG. 2A with a push-button eyelet prossed into a structural unit.

In the inventive embodiment according to FIG. 1A, deviating from the known embodiment of FIG. 2A, a region of a rivet flange 5' is formed by a window section 17 that extends approximately parallel to an axis Y of a rivet shank 4' and leads away from the calotte-shaped button 1'. Supporting clips 14' are formed in the window section 17 by punching and bending. The window section 17 merges into a supporting section 18 that proceeds transversely relative to the axis Y and at a distance from the calotte-shaped button 1'. A transition section 19 that extends approximately parallel to the axis Y and defines, together with the window section 17, the spacing of the supporting section 18 from the calotte-shaped button 1', adjoins this supporting section 18. The transition section 19 terminates in an outer edge 6' of the rivet flange 5'. The outer edge 6' lies directly against an underside 23 of the top plate 22 of the calotte-shaped button 1' in that region thereof from which the button edge 7' of the button 1' is conducted down, and is approximately parallel to the axis Y for fixing the rivet part 2'.

The position of an edge 9' of a cylinder portion 10' of the eyelet 3' having a central opening 10' a is thus matched to the position of the outer flare edge 15' of the eyelet 3' that the flexible material can be pressed not only vertically between the edge 9' of the cylinder portion 10' of the eyelet 3' and the rivet flange 5' at a circular location $P_1$, but also horizontally between the cylinder portion 10' and the window section 17 at the circular location $P_2$, and also vertically between the outer flare edge 15' of the eyelet 3' and the supporting section 18 of the rivet flange 5' at the circular location $P_3$.

Figure 1B:
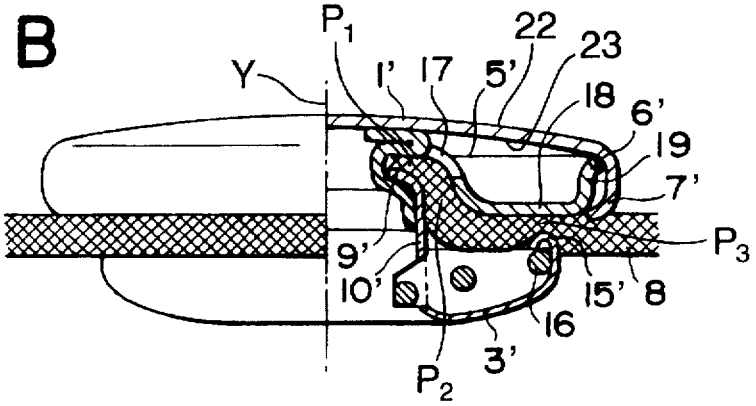
FIG. 1B is an axial section of the closure part of FIG. 1A with a press-button eyelet pressed together into a structural unit.

Given the embodiment of the invention shown in FIG. 1A and FIG. 1B, the button edge 7' is conducted up to the supporting section 18 of the rivet part 2'.

FIG. 1B reveals that the rivet shank 4' is widened only over roughly its lower half facing away from the rivet flange 5', being widened until it is seated against the outside wall that terminates in the edge 9' of the cylinder portion 10' of the eyelet 3'. The upper half of the rivet shank 4' is deformed in the direction toward the rivet flange 5' while being seated against and entraining that edge 9' of the cylinder portion 10' of the eyelet that projects inward, i.e., projects transversely relative to the axis Y. and also presses the flexible material 8. The rivet shank is thus deformed into a shallow S-shaped cross section all around the axis Y.

Although modifications and changes may be suggested by those skilled in the art, it is the intention of the inventors to embody within the patent warranted hereon all changes and modifications as reasonably and properly come within the scope of his contribution to the art.

The invention claimed is:

1. In a push-button closure part composed of a calotte-shaped metallic button, a metallic rivet part having a rivet shank that projects from the underside of the button and having an approximately radially extending, round rivet flange which under an edge thereof a downwardly and inwardly deformable button edge engages, and which comprises supporting clips formed by punched windows in the region between the edge of the rivet flange and the rivet shank, the clips being bent over onto themselves such that they lie against and support the central region of the calotte-shaped button, and a push-button eyelet having a central opening that is slipped onto the rivet shank, and that, by deforming the rivet shank, the eyelet is fixed with the rivet shank and, thus, the calotte-shaped button while pressing the material between the edge of the central opening of the eyelet and the rivet flange, the improvement comprising:

said rivet part including a window section, having supporting clips cut and bent therefrom, said window section extending approximately parallel to an axis of the rivet shank, leads away from the calotte-shaped button and merges into a supporting section that proceeds transversely relative to the axis and at a distance from the calotte-shaped button; and a transition section extending approximately parallel to the axis and together with the window section defining the distance of the supporting section from the calotte-shaped button, said transition section adjoins the supporting section, said transition section terminating in an outer edge against the calotte-shaped button, a button edge conducted downward and inward approximately parallel to the axis for fixing the rivet part; and the position of the edge of the central opening of the eyelet is matched such to the position of an outer flare edge of the eyelet that the flexible material is pressed between the edge of the central opening of the eyelet and the rivet flange and also pressed between the outer flare edge of the eyelet and the supporting section of the rivet flange.

2. The improvement according to claim 1, wherein the button edge extends down to the supporting section of the rivet part.

3. The improvement according to claim 1 wherein the rivet shank is widened only over roughly its lower half facing away from the rivet flange until it is seated against the outside wall terminating in the edge of the central opening of the eyelet and has its upper half deformed in the direction toward the rivet flange while being seated against the edge of the central opening of the eyelet, projecting transversely relative to the axis and pressing the material.

4. A push-button closure part engageable to a flexible material, comprising:

a button cover having a top plate and surrounding edge region;

a rivet part having a rivet shank and a surrounding rivet flange, said button cover surrounding edge region engaging said surrounding rivet flange to connect said rivet part to said button cover;

a push-button eyelet having a body portion with a central cylinder portion having an inwardly flared end defining a central opening for receiving said rivet shank when said flexible material is pressed between said rivet flange and said body portion, said rivet part including a first section extending substantially perpendicularly away from an underside of said top plate of said button cover, a second section extending substantially parallel and spaced apart from said top plate, and a third section extending from the second section toward said underside, of said top plate, a terminal edge of said third section abutting said underside of said top plate; and said rivet shank is deformed to fix said rivet shank to said cylinder, and said rivet shank is stretched open at a lower end thereof forming said rivet shank into a shallow S-shape in cross-section around axis an of said rivet shank.

5. The push-button closure part according to claim 4, wherein said edge region of said button cover comprises a rolled outer edge which engages said third section of said rivet flange.

6. The push-button closure part according to claim 4, wherein said rivet part includes supporting clips cut and bent from said first section and pressed to an underside of said top plate of said button cover.

7. The push-button closure part according to claim 4 wherein said top plate of said button cover is spherically contoured.

8. The push-button closure part according to claim 4 wherein said first section and said cylinder portion are shaped to press said flexible material therebetween in a first direction between an edge of said cylinder portion and said rivet flange and in a second direction between a side of said cylinder portion and said first section.

9. The push-button closure part according to claim 4 wherein said body portion of said eyelet includes a pressing outer edge spaced from and surrounding said cylinder portion, said pressing outer edge sized to be opposite said second section across a thickness of said flexible material, said flexible material pressed between said cylinder portion and said rivet flange and pressed between said pressing outer edge and said second section.

* * * * *